United States Patent [19]

Yoshioka

[11] Patent Number: 4,463,711

[45] Date of Patent: Aug. 7, 1984

[54] CARBURETION SYSTEM FOR A V-TYPE INTERNAL COMBUSTION ENGINE

[75] Inventor: Yuichi Yoshioka, Sayama, Japan

[73] Assignee: Honda Giken Kogyo Kabushiki Kaisha, Tokyo, Japan

[21] Appl. No.: 409,529

[22] Filed: Aug. 19, 1982

[30] Foreign Application Priority Data

Aug. 19, 1981 [JP] Japan ..... 56-130583

[51] Int. Cl.[3] ..... F02B 75/18; F02B 13/00

[52] U.S. Cl. ..... 123/52 MV; 123/55 VF; 123/55 VS; 123/55 VE; 123/59 PC; 123/580

[58] Field of Search ..... 123/579, 580, 59 PC, 123/52 MV, 55 VE, 55 VF, 55 VS

[56] References Cited

FOREIGN PATENT DOCUMENTS

| | | | |
|---|---|---|---|
| 663379 | 5/1963 | Canada | 123/52 MV |
| 161948 | 12/1980 | Japan | 123/580 |
| 56-72229 | 6/1981 | Japan | 123/579 |
| 2052412 | 1/1981 | United Kingdom | 123/52 MV |

*Primary Examiner*—Ethel R. Cross

*Attorney, Agent, or Firm*—Armstrong, Nikaido, Marmelstein & Kubovcik

[57] ABSTRACT

An improved carburetion system for a V-type internal combustion engine including a first carburetor and a second carburetor disposed in a space between a first cylinder and a second cylinder arranged in the form of V-shape and adapted to supply an air-fuel mixture to the respective cylinders, said carburetors each having an intake barrel defining an intake passage leading to the associated cylinder respectively. A common intake box having at least an air inlet opening formed on the side walls thereof is provided between both the first and second cylinders in such a manner that the first and second carburetors are connected to said common intake box. Each of the intake barrels has an inlet port which is opened toward the interior of the common intake box and an air horn made of resilient material is connected to said inlet port so that said air horn extends into the interior of the common intake box.

7 Claims, 4 Drawing Figures

CARBURETION SYSTEM FOR A V-TYPE INTERNAL COMBUSTION ENGINE

BACKGROUND OF THE INVENTION

1. Field of the Invention

The present invention relates to an improved carburetion system for a V-type internal combustion engine mounted on a vehicle including a first cylinder and a second cylinder which are arranged in the form of V-shape and more particularly to a carburetion system including a first carburetor and a second carburetor which are arranged in the space between the first and second cylinders to constitute an intake system for the cylinders.

2. Description of the Prior Art

Usually, a carburetor is connected to an intake barrel by way of a thermal insulation sleeve made of rubber or the like material so as not to be possibly affected by heat conducted from the intake barrel or the like. Thus, it is movable to some extent due to deformation of the thermal insulation sleeve. However, when a first carburetor and a second carburetor are to be disposed in a closely spaced relation in the limited space between a first cylinder and a second cylinder of the V-type internal combustion engine, there is a tendency of causing a collision of both the carburetors against one another during free movement of the carburetors.

SUMMARY OF THE INVENTION

The present invention is intended to obviate the drawback inherent to the conventional carburetion system as described above. Thus, it is a principal object of the present invention to provide an improved carburetion system for a V-type internal combustion engine of the above kind which is constructed such that a common intake box having at least an air inlet opening formed on one side wall thereof is provided between both the first and second cylinders in such a manner that the first and second carburetors are connected to said common intake box, and each of the intake barrels has an inlet port which is opened toward the interior of the common intake box, whereby free movement of the first and second carburetors is substantially restricted by firmly holding the latter by way of the common intake box.

It is other object of the present invention to provide a carburetion system which is constructed such that the carburetors are arranged in the limited space between the first and second cylinders without any fear of collision of the carburetors against one another.

It is another object of the present invention to provide a carburetion system which ensures smooth delivery of intake air to the respective carburetors without any interference.

It is still another object of the present invention to provide a carburetion system which is simple in structure and functions reliably.

The above and other objects and advantageous features of the present invention will be readily apparent from the reading of the following description made in connection with the accompanying drawings.

BRIEF DESCRIPTION OF THE DRAWINGS

FIG. 1 is a schematic elevational side view of a V-type internal combustion engine equipped with a carburetion system in accordance with the present invention and FIGS. 2 to 4 illustrate the carburetion system in FIG. 1, shown in an enlarged scale, wherein FIG. 2 is a vertical sectional side view of the carburetion system taken in line II—II in FIG. 4, FIG. 3 is a partial sectional view of the carburetion system taken in line III—III in FIG. 2 and FIG. 4 is a sectional plan view of the carburetion system taken in line IV—IV in FIG. 2.

DESCRIPTION OF THE PREFERRED EMBODIMENT

Now the present invention will be described in more details with reference to the accompanying drawings which illustrate a preferred embodiment of the present invention.

Figure 1:
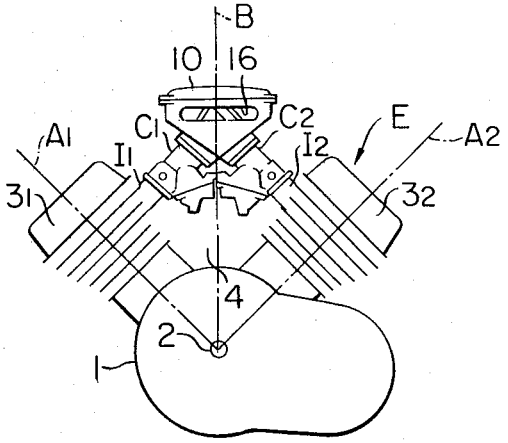

Referring first to FIG. 1, a V-type internal combustion engine as identified by reference letter E is mounted on a motorcycle and includes a crank case 1 with a crankshaft 2 rotatably held therein, said crankshaft 2 extending transversely of the frame of the motorcycle. The engine E has two cylinders; namely, a first cylinder $3_1$ and a second cylinder $3_2$ which are arranged longitudinally of the frame of the motorcycle in the form of V-shape. A first caburetor $C_1$ and a second carburetor $C_2$ constituting intake systems for the first and second cylinders $3_1$ and $3_2$ are arranged in a V-shaped space formed between both the first and second cylinders $3_1$ and $3_2$. In the illustrated embodiment of the present invention the engine E includes two cylinders $3_1$ and $3_2$ and two carburetors $C_1$ and $C_2$ but the present invention should not be limited only to this and it does not exclude such a case where two or more first and second cylinders as well as two or more carburetors are arranged in the axial direction relative to the crankshaft 2.

While neglecting the axial offset between both the first and second cylinders $3_1$ and $3_2$, the first carburetor $C_1$ and the second carburetor $C_2$ are arranged in symmetry with respect to a bisector line B of the angle involved between both the axes $A_1$ and $A_2$ of the first and second cylinders $3_1$ and $3_2$.

Figure 2:
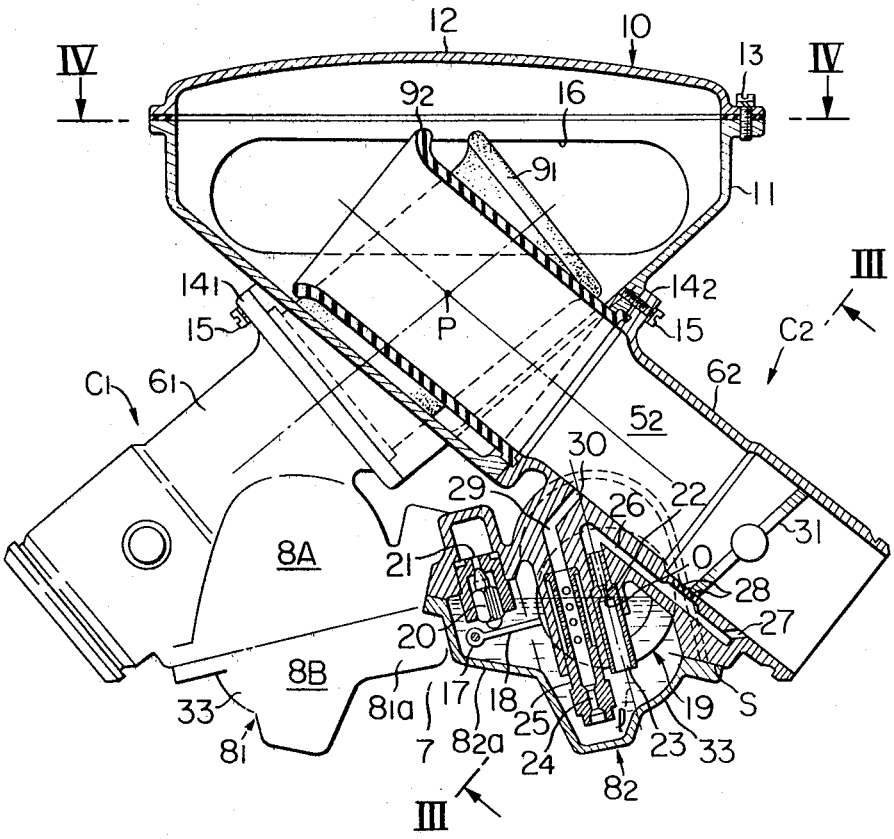
Figure 4:
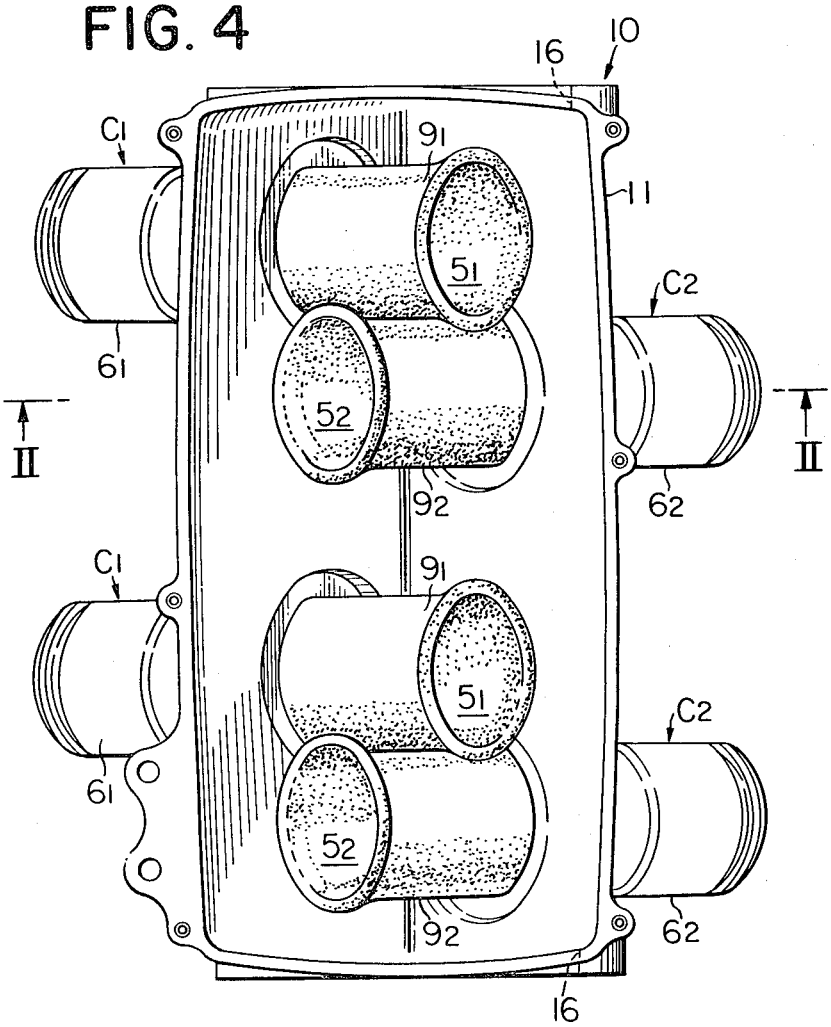

As will be apparent from FIGS. 2 and 4, the first carburetor $C_1$ and the second carburetor $C_2$ include intake barrels $6_1$ and $6_2$ defining their intake passages $5_1$ and $5_2$ therein. The intake barrels $6_1$ and $6_2$ extend at a substantially right angle relative to the axes $A_1$ and $A_2$ of the first and second cylinders respectively. The intake barrels $6_1$ and $6_2$ arranged in a closely spaced relation are inclined relative to the horizontal plane. It is preferable that these intake barrels are arranged in such a manner as to contact one another and intersect one another at a predetermined angle as illustrated in the accompanying drawings. The intake barrels $6_1$ and $6_2$ are connected to the associated cylinders $3_1$ and $3_2$ with thermal insulation sleeves $I_1$ and $I_2$ interposed therebetween, said thermal insulation sleeves $I_1$ and $I_2$ being made of rubber or the like material.

The point P of intersection of both the intake barrels $6_1$ and $6_2$ is offset from the middle part of the intake barrels toward the inlet port of the latter whereby an ample space 7 is provided below the point P of intersection between both the intake barrels $6_1$ and $6_2$. Further, float chambers $8_1$ and $8_2$ attached to the carburetors $C_1$ and $C_2$ are provided in said space 7. Further, as shown in FIGS. 2 and 4, the float chambers $8_1$ and $8_2$ are formed with extension chambers $8_{1a}$ and $8_{2a}$ which extend toward one another and are located side by side so that a required volume of fuel storage is ensured for the respective float chambers $8_1$ and $8_2$.

Each of the float chambers $8_1$ and $8_2$ is constructed of a float chamber body 8A formed integrally with the lower part of the intake barrels $6_1$ and $6_2$ and opened at the lower face thereof and a lower cover 8B adapted to be jointed to the lower open face of the float chamber body 8A, wherein the lower cover 8B is inclined relative to the horizontal plane at an angle of inclination smaller than that of the intake barrels $6_1$ and $6_2$.

Figure 3:
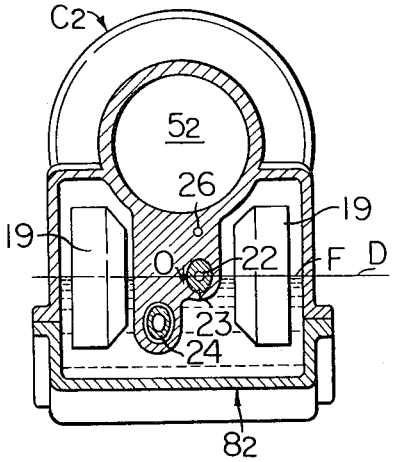

Each of the float chambers $8_1$ and $8_2$ includes therein a pair of floats 19 which are connected to one another by way of a swingable arm 18. This swingable arm 18 is swingably supported by means of a pivotal shaft 17 for ensuring free swinging movement thereof in the upward or downward direction. The pivotal shaft 17 is pivotally held by means of bearings formed integrally with the float chamber body 8A in the extension chamber $8_{1a}$ and $8_{2a}$ and extends in parallel to the crankshaft 2. Further, each of the extension chambers $8_{1a}$ and $8_{2a}$ includes a fuel inlet port 21 which is opened at the lower face of the float chamber body 8A and a float valve 20 is operatively connected to the swingable arm 18 in such a manner as to open or close the fuel inlet port 21 in conformance with the upward or downward movement of the swingable arm 18. Therefore, as a level of fuel in the float chambers $8_1$ and $8_2$ is lowered due to consumption of fuel, the float 19 is lowered and thereby the float valve 20 is caused to open. Fuel is then supplied into the float chambers $8_1$ and $8_2$ from a fuel tank (not shown) by way of the fuel inlet port 21 until the predetermined level of fuel is restored in the respective float chambers $8_1$ and $8_2$. As shown in FIG. 3, the fuel surface is identified by reference letter F and the center of the fuel surface, that is, the position where no change in level of fuel occurs irrespective of any inclination of the fuel surface F is identified by reference letter O.

Each of the pair of floates 19 has a cylindrical or frusto-conical form or a composite form of the preceding ones of which center axis D extends in parallel to the axis of the crankshaft 2. Specifically, the floats 19 are designed such that a draft line passes through the center of the floats 19 when the latter float on the fuel surface F. The pair of floats 19 are arranged such that the center O of the fuel surface F is located at the middle position therebetween. Thus, the float 19 is not caused to move up or down irrespective of any inclination of the fuel surface F in any direction but they move only in conformance with substantial change in the level of the fuel surface F.

Each of the float chambers $8_1$ and $8_2$ includes a slow fuel pipe 23 with a slow jet 22 incorporated therein and a main fuel pipe 25 with a main jet 24 incorporated therein, said slow and main fuel pipes 23 and 25 being inclined at a certain angle relative to the axis of the intake passages $5_1$ and $5_2$ and extending through the float chamber body 8A. Specifically, the slow fuel pipe 23 is arranged such that its axis extends as close as possible by the center O of the fuel surface, whereas the main fuel pipe 25 is arranged such that its axis extends in parallel to that of the center O of the fuel surface, extending as close as possible by the center O of the fuel surface. Thus, the floats 19 move up and down in parallel to the axis of the slow fuel pipe 23 in the vicinity of the center O of the fuel surface in conformance with change in the level of the fuel surface. The slow fuel pipe 23 is connected to an idle port 27 and a bypass port 28 at the upper end thereof by way of a fuel passage 26, said idle port 27 and bypass port 28 being opened toward the respective intake passages $5_1$ and $5_2$. On the other hand, the main fuel pipe 25 is connected to a main nozzle 30 at the upper end thereof by way of a fuel passage 29, said main nozzle 30 being opened toward the respective intake passages $5_1$ and $5_2$. Specifically, the main nozzle 30 is located at a substantially right angle relative to the respective passages $5_1$ and $5_2$. It should be noted that reference numeral 31 designates a throttle valve disposed in the respective intake passages $5_1$ and $5_2$.

As will be apparent from FIGS. 2 and 3, the upper portion of the intake barrels $6_1$ and $6_2$ at which the latter intersect one another is constituted of air horns $9_1$ and $9_2$ made of resilient material such as rubber or the like, said air horns $9_1$ and $9_2$ being housed in a common intake box 10 having a substantially inverted triangle-shaped cross-sectional configuration and extending in parallel to the crankshaft 2. The common intake box 10 is constituted of a housing 11 opened at its upper end face and a lid 12 adapted to be fixedly secured to the upper end face of said housing 11 by means of set screws 13 so as to close the upper open face therewith. Further, the common intake box 10 is formed with flange portions at the lower part of the housing 11 to which mounting flanges $14_1$ and $14_2$ provided at the intermediate portion of the intake barrels $6_1$ and $6_2$ are firmly secured by means of set screws 15. Thus, all the carburetors $C_1$ and $C_2$ are connected integrally to one another by way of the common intake box 10. The housing of the common intake box 10 is formed with air inlet openings 16 on both the left- and right-hand side walls, said air inlet openings 16 being fitted with an air cleaner (not shown) respectively.

Now, assembling of the carburetion system constructed in the above-described manner will be described below. First, the mounting flanges $14_1$ and $14_2$ of the first and second carburetors $C_1$ and $C_2$ are fixedly secured to the housing 11 by tightening the set screws 15 and then the air horns $9_1$ and $9_2$ are firmly fitted into the annular groove on the mounting flanges $14_1$ and $14_2$ within the housing 11. Finally, the lid 12 is fixedly secured to the upper flange of the housing 11 by tightening the set screws 13. It will be readily understood that the above-described arrangement makes it possible to assemble the intake barrels $6_1$ and $6_2$ into the common intake box 10 without any particular difficulty in such a manner they intersect one another.

During idling or slow speed running of the engine E with the throttle valves 31 in both the first and second carburetors $C_1$ and $C_2$ held at the idle opening or reduced opening position, fuel stored in the float chambers $8_1$ and $8_2$ is sucked up through the slow fuel pipe 23. After it is metered at the slow jet 22, it is introduced into the intake passages $5_1$ and $5_2$ through the idle port 27 or the bypass port 28 by way of the fuel passage 26. Then, atomized fuel is mixed with intake air whereby an airfuel mixture having a density required for the idling or low speed running of the engine is prepared. The mixture is then introduced into the respective cylinders $3_1$ and $3_2$.

As the engine is operated at a high speed with the throttle valve 31 opened to an increased extent, fuel in the float chambers $8_1$ and $8_2$ is sucked up by way of the main fuel pipe 23. After it is metered at the main jet 24, it is introduced into the intake passages $5_1$ and $5_2$ through the main nozzle 30 by way of the fuel passage 29 and then atomized fuel is mixed with intake air whereby an air-fuel mixture having a density required for the high speed running of the engine is prepared. The mixture is then introduced into the respective cylinders $3_1$ and $3_2$.

As described above, the carburetion system in accordance with the present invention is constructed such that the first and second carburetors disposed between the first and second cylinders of a V-type internal combustion engine are firmly connected to one another by way of the common intake box with air inlet openings formed on the side walls thereof. Thus, both the carburetors are effective in holding one another by way of the common intake box, resulting in their limited free movement without any possibility of causing a collision therebetween. Further, it is possible that both the carburetors are arranged in a closely spaced relation in the limited space between the first and second cylinders and below the common intake box without difficulty.

Owing to the arrangement that the intake barrels of the first and second carburetors are opened toward the inside of the common intake box at their inlet port, it is ensured that intake air is distributed from the common intake box into the respective intake barrels with extremely reduced resistance against flowing of intake air. As a result an excellent improvement in engine performance at a high speed running is achieved.

Further, since the common intake box serves also as a joint member between the first and second carburetors, the whole carburetor system can be constructed of the reduced number of parts and members with necessity for substantially reduced space in a simple manner.

Furthermore, since the common intake box includes air horns fitted therein which constitute a part of the intake barrels of both the carburetors, the common intake box provides a space in which a part of the intake barrels is accommodated whereby the whole carburetion system including the common intake box can be arranged in a more limited space. As a result, it is ensured that the carburetion system is installed in an extremely reduced space between both the cylinders without any particular difficulty.

What is claimed is:

1. In an improved carburetion system for a V-type internal combustion engine including a first carburetor and a second carburetor disposed in a space between a first cylinder and a second cylinder arranged in the form of V-shape and adapted to supply an air-fuel mixture to the respective cylinders, said carburetors each including an intake barrel defining an intake passage leading to the associated cylinder, the improvement consisting in that a common intake box having air inlet openings is provided between both the first and the second cylinders in such a manner that said first and second carburetors are connected to said common intake box, and each of said intake barrels has an inlet port which is opened toward the interior of said common intake box, said intake barrels being arranged at substantially right angles relative to the axis of the associated cylinders so that they intersect one another in a proximate relation.

2. A carburetion system as defined in claim 1, wherein the intake barrel includes a float chamber projecting downward from the lower part thereof, said float chamber being filled with fuel and including a float adapted to move up and down in conformance with change in fuel level, a float valve actuated by means of said float so as to keep the fuel level constant and fuel passage means by way of which fuel is introduced into the intake passage, said fuel passage means including a portion which extends to the float chamber, said portion being inclined at a certain angle relative to the axis of the intake passage, said float being adapted to move in parallel to the axis of the portion of the fuel passage means extending to the float chamber.

3. A carburetion system as defined in claim 2, wherein the fuel passage means comprises a slow fuel passage including a slow fuel pipe extending to the float chamber and a main fuel passage including a main fuel pipe extending to the float chamber, said slow fuel pipe and main fuel pipe extending in parallel to one another and being located as close as possible to the center of the fuel surface.

4. A carburetion system as defined in any one of claims 1, 2, 3, wherein each of said intake barrels includes an air horn fitted to the one end thereof, said air horn extending into the interior of the common intake box.

5. A carburetion system as defined in claim 4, wherein the air horn is made of resilient material.

6. A carburetion system as defined in claim 1, wherein the air inlet opening is provided on the one side wall of the common intake box.

7. A carburetion system as defined in claim 1, wherein the common intake box is located at the position where the intake barrels intersect one another.

* * * * *